US005402611A

United States Patent [19]

Vagedes

[11] Patent Number: 5,402,611

[45] Date of Patent: Apr. 4, 1995

[54] ROOF VENT

[76] Inventor: Michael Vagedes, 778 Ridgeview Dr., Florence, Ky. 41042

[21] Appl. No.: 46,076

[22] Filed: Apr. 12, 1993

[51] Int. Cl.[6] ..... E04H 12/28

[52] U.S. Cl. ..... 52/198; 52/199; 52/57; 52/101; 454/366

[58] Field of Search ..... 454/364, 365, 366, 367; 52/198, 199, 57, 518, 101

[56] References Cited

U.S. PATENT DOCUMENTS

| | | | |
|---|---|---|---|
| 2,888,716 | 6/1959 | Kaufmann | 52/101 |
| 3,094,915 | 6/1963 | Leigh | 454/366 |
| 3,282,000 | 11/1966 | Shaw et al. | 52/101 |
| 3,407,550 | 10/1968 | Shaw | 52/101 |
| 3,862,529 | 1/1975 | Markos . | |
| 3,949,657 | 4/1976 | Sells . | |
| 4,297,818 | 11/1981 | Anderson | 454/366 |
| 4,577,442 | 3/1986 | Callaway | 52/57 |
| 4,907,499 | 3/1990 | James . | |
| 4,915,022 | 4/1990 | Lynch . | |
| 4,942,699 | 7/1990 | Spinelli | 52/57 |
| 5,078,047 | 1/1992 | Wimberly | 454/366 |
| 5,092,225 | 3/1992 | Sells . | |

FOREIGN PATENT DOCUMENTS 2027469 2/1980 United Kingdom .

*Primary Examiner*—Carl D. Friedman
*Assistant Examiner*—Christopher Todd Kent

[57] ABSTRACT

A passive roof vent is provided with a planar upper surface which includes channels on the sides and bottom of the panel to hold shingles. The side channels are stepped to permit two layers of shingles to be inserted over the top surface and provide a shingled appearance. This provides an aesthetically appealing roof vent which has an upper surface which blends in with a shingled roof.

13 Claims, 3 Drawing Sheets

ROOF VENT

DETAILED DESCRIPTION

In order to avoid moisture and heat build tip in roofs, it is important to provide venting. There are many different types of vents. There are active vents which employ fans. Certain vents use the ambient air flow to turn a turbine blade which in turn pulls air from beneath the roof. There are also passive vents which merely provide an opening through the roof surface and prevent water from flowing into the roof. These passive roof vents take many different shapes and sizes.

One particular type of passive roof vent simply includes a base plate with a shaft portion which is covered with a flat cap. These are quite functional, inexpensive, and easy to install. However, they are aesthetically unappealing. Looking at a roof on a new house with the singles in perfect array, one immediately is distracted by the metal or plastic roof vents.

SUMMARY OF THE INVENTION

The present invention is premised on the realization that a passive roof vent having a top surface with channels adapted to receive and retain shingles can provide a passive roof vent which is aesthetically appealing. The present invention is further premised on the realization that when these channels are stepped, they can provide a means to hold an upper and lower shingle which provide a shingled appearance blending in with the roof surface.

The roof vent of the present invention is designed to blend in with the roof surface. Thus, when one observes a shingled roof, the roof vents are not immediately apparent. The objects and advantages of the present invention will be further appreciated in light of the following detailed description and drawings in which:

DETAILED DESCRIPTION OF THE DRAWINGS

DETAILED DESCRIPTION

Figure 1:
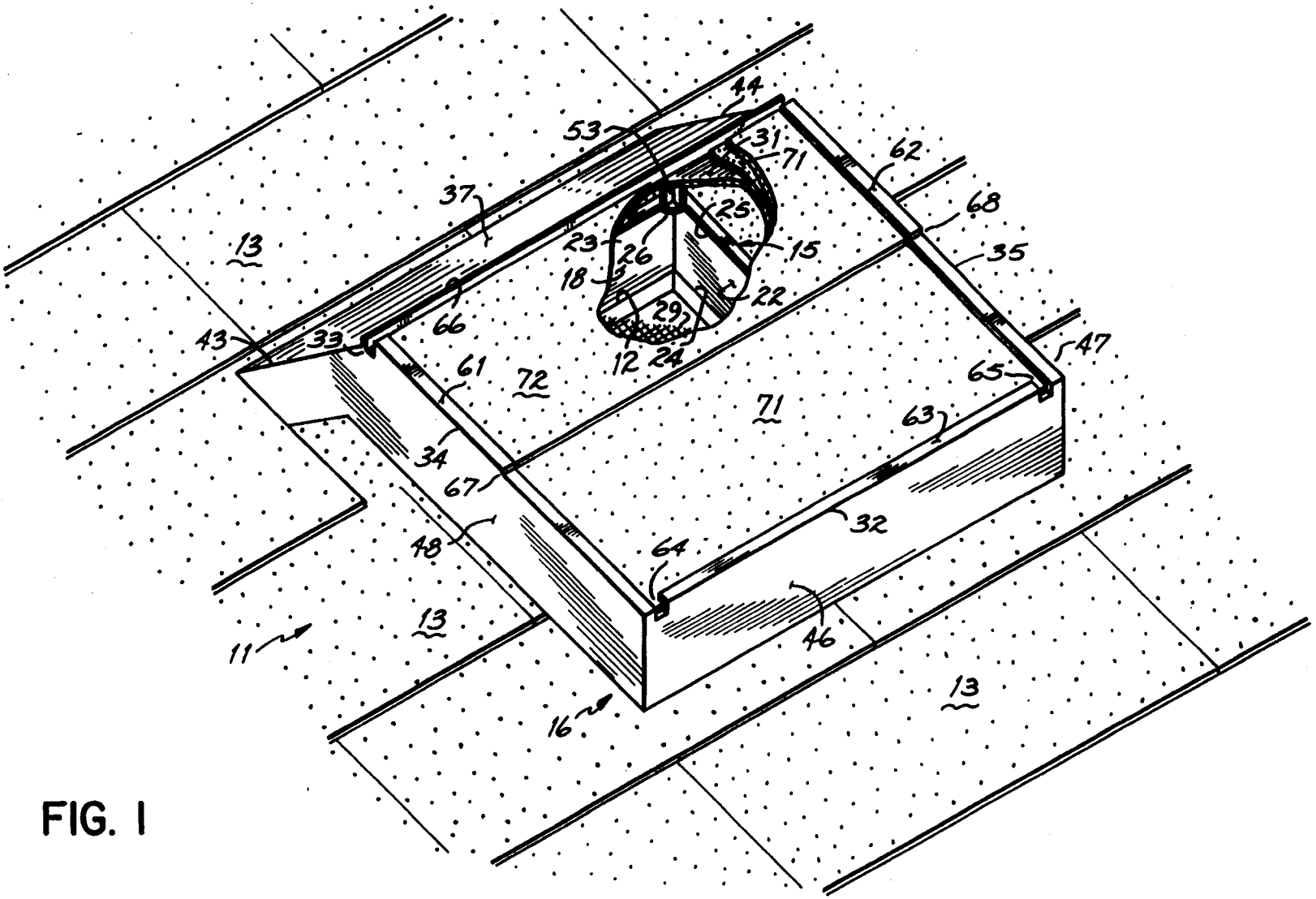
FIG. 1 is a perspective view of a roof incorporating the roof vent of the present invention.

As shown in FIG. 1, a roof vent 11 is mounted to a roof surface 12 which is covered with singles 13. The roof vent 11 includes the base plate 14 (see FIG. 2) and an upwardly extended portion or shaft portion 15 which is covered with a cap or top 16.

The shalt portion 15 includes a forward wall 17, a rear wall 18, a first side wall 21, and a second side wall 22. As shown in FIG. 1, this provides an tipper opening 23 and a lower opening 24 which is designed to provide access through the roof 12. Shaft portion 15 also includes an tipper peripheral flange 25 extended around the walls 17, 18, 21, and 22. The peripheral flange 25 also includes six tabs 26 each having a hole.

The cap 16 includes a top surface 31 which is a rectangular panel having a forward edge 32, a rear edge 33, a first side edge 34, and a second side edge 35. The cap 16 has three walls, a forward wall 46 which extends down from the forward edge 32 and two side walls 47 and 48 which extend down from the side edges of the top surface 31.

Figure 2:
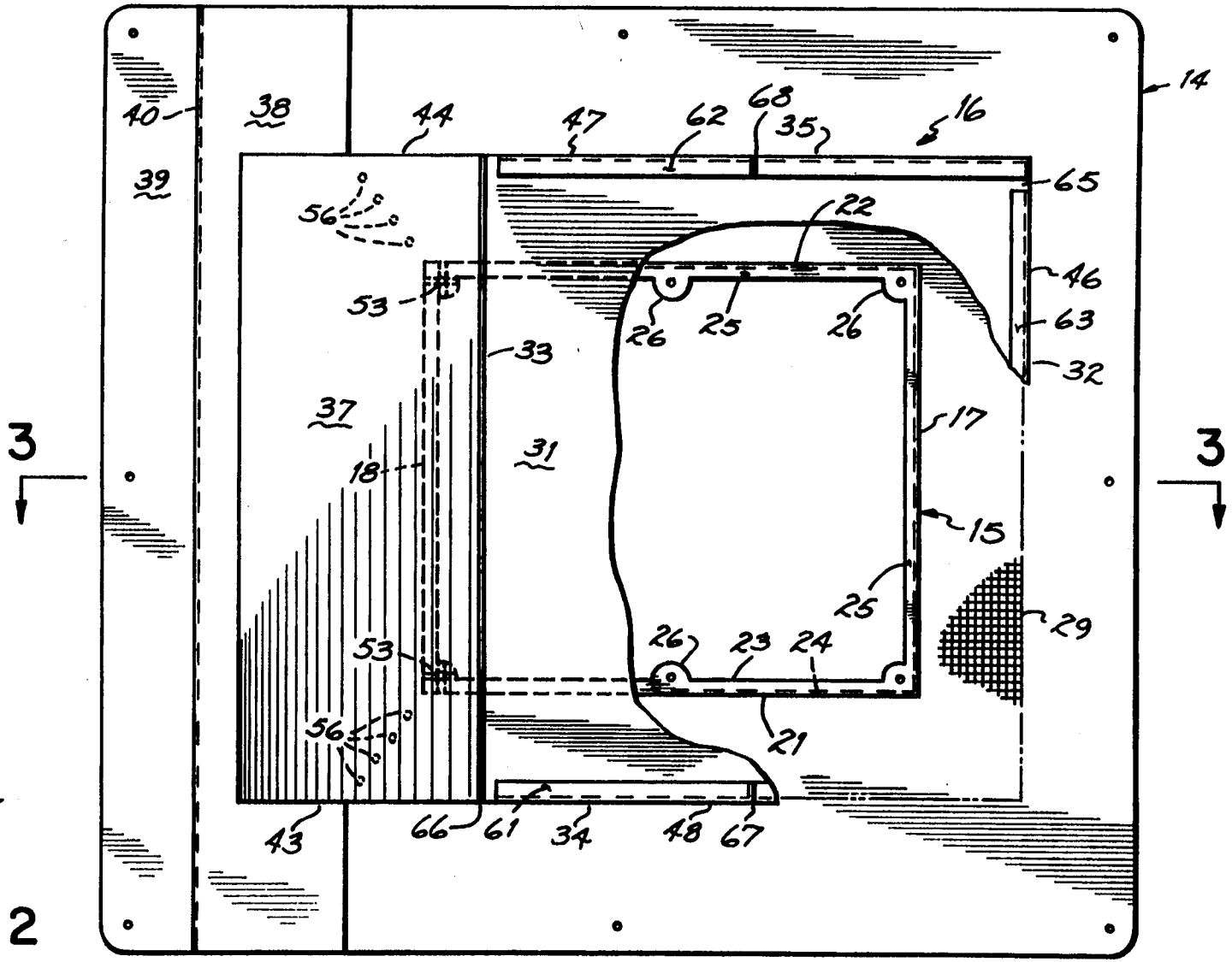
FIG. 2 is an overhead plan view partially broken away of the present invention.
Figure 3:
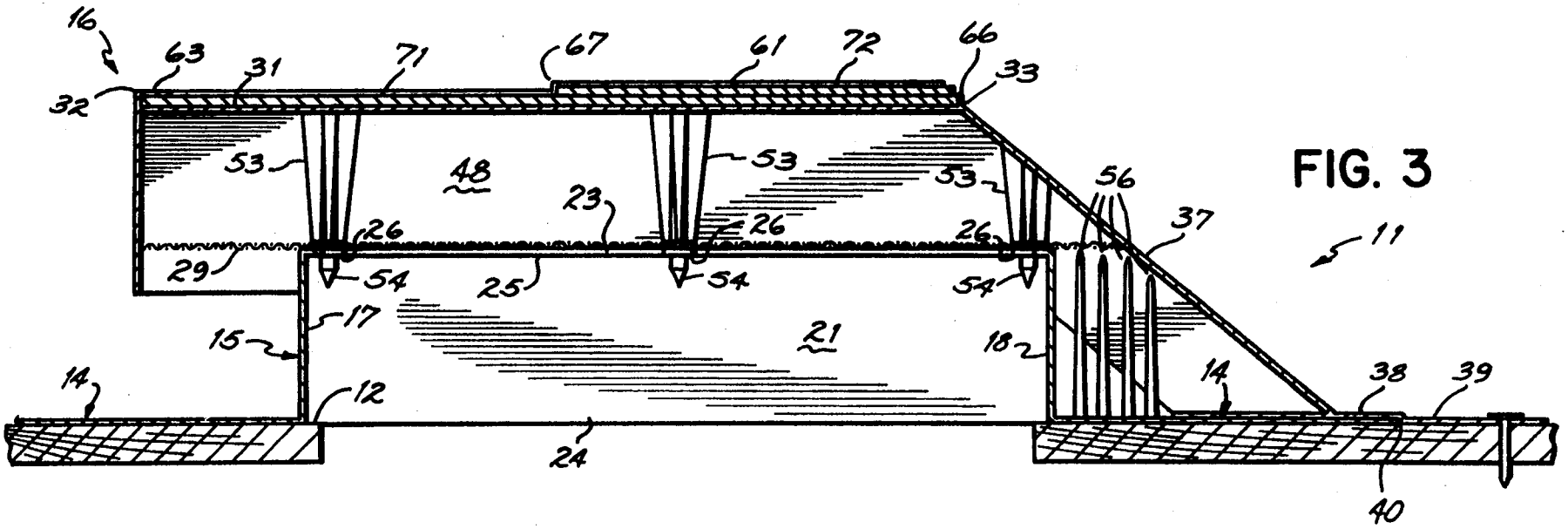
FIG. 3 is a cross-sectional view taken at lines 4—4 of FIG. 2.

Extended beyond the rear edge 33 is a sloped panel 37 which extends to a base portion 38. Sloped panel 37 also includes a first side edge 43 and a second side edge 44. As shown in FIGS. 1 and 2, base portion 38 runs the entire width of base plate 14 and is bonded to base plate 14 at the upper edge 40 of base plate 14. Base portion 38 extends beyond the upper edge 40 of the base plate 14 and is stepped at 39 to provide a fiat surface resting on the roof surface.

The bottom or underside of cap 16 has six downwardly extending posts 53 which have tapering cross-shaped, cross-sectional configurations. These posts terminate in pins 54 which extend through the holes in tabs 26 on the base portion and are glued or welded thereto. Between the posts and the base is a section, a screen which is held in place between posts 53 and tabs 26.

A series of spikes 56 extend from the base 14 tip from the base towards the sloped panel 37 blocking the area behind the back wall 18. These spikes prevent birds from nesting in the vent between the back wall 18 and sloped panel 37.

The top surface 31 of cap 16 retain shingles covering the top surface by engaging the peripheral edges of the shingles. Although there are a variety of different tabs and clips which could be employed, the embodiment shown in the figures includes first and second side channels 61 and 62 which lie on the first and second side edges 34 and 35 of the top surface 31. The first and second side channels 61 and 62 both have a stepped portion 67 and 68. A bottom channel 63 runs along the forward edge 32. There are small gaps 64 and 65 between the bottom channel 63 and the side channels 61 and 62 to permit water drainage. At the rear edge of top surface 31 is an tipper ridge or projection 66.

The vent 11 is installed on a roof 12 by nailing the base plate 14 and base portion 38 of cap 16 onto the surface of roof 12 over a vent hole in roof. Shingles are installed on the roof covering the base plate 14 and base portion 38. A first shingle 71 is cut to size and slid along the first and second side channels 61 and 62 all the way to the bottom channel 63. Its length extends up to the upper ridge 66 which keeps it from sliding out. A second shingle 72 is cut to size and slid into side channel 61 and 62. This will engage the stepped portions 67 and 68 of the side channel 61 and 62, and likewise it will extend all the way up to the upper ridge 66. Thus, the upper surface of the vent is completely covered with singles. Because of the stepped configuration of channel 61 and 62, the shingles 71 and 72 provide overlapping appearance which blends in with the shingled roof surface.

Figure 4:
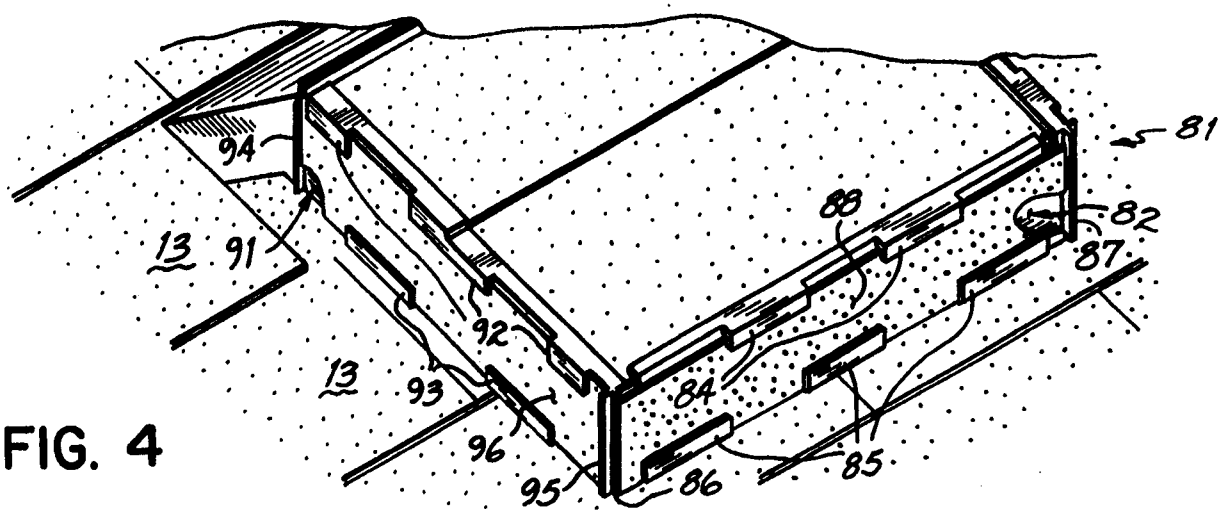
FIG. 4 is a partial front perspective view of an alternate embodiment of the present invention.

In an alternate embodiment shown in FIG. 4, the vent 81 is configured in the same manner as vent 12. However, the front panel 82 includes spaced upper and lower channel sections 84 and 85 and lateral ridges 86 and 87. Ridge 86 is not as high as ridge 87. A piece of shingle 88 is also placed in these sections to cover front panel 82. The resiliency of the shingle 88 permits it to pass override 86 between channel sections 84 and 85. Once in position, it will remain held by ridges 86 and 87.

A similar channel system is provided for the side walls. Only side wall 91 is shown. As with front panel 82, side wall 91 includes upper and lower channel sections 92 and 93 and lateral ridges 94 and 95. Again, channel 94 is smaller than channel 95. Side wall 91 is also covered with a cut to size piece of shingle 96 held in place by channel sections 92 and 93. Thus, in this embodiment, the top surfaces as well as the side surfaces are covered with shingles.

The vent of the present invention, of course, can be pressed from metal such as aluminum or tin, or alternately can be injection molded with plastic such as polypropylene. The present invention is particularly suitable for plastic vents since not only does the shingle covering provide an aesthetically appealing exterior, it shields the plastic surface from sunlight, in turn reducing ultraviolet light degradation of the plastic.

Further, the use of channels or tabs to engage the periphery of the shingles allows the shingles to be held in position on the vent without a penetrating fastener such as a screw or nail. This makes installation easier and prevents potential damage to the vent. Of course, there are several ways of practicing the present invention with a metal vent, clips can be used instead of channels. Likewise, if desired, a different shaped top surface can be used such as a circular shape with annular channels or clips.

The preceding has been a description of the preferred embodiment of the present invention currently known to the inventor.

The invention itself should only be defined by the appended claims wherein I claim:

1. A roof vent having a base adapted to be fixed to the surface of a roof, and a shaft extended up from said base, a cap covering said shaft and having a top surface, at least one shingle covering said top surface, said top surface having peripheral edges engaging peripheral edges of said shingle to retain said shingle on said top surface without penetrating said shingles.

2. The roof vent claimed in claim 1 wherein said top surface has a first and second edge and a third bottom edge, said first and second edges having first and second opposed channels and said bottom edge having a third channel wherein said channels provide said means engaging peripheral edges of said shingle.

3. The vent claimed in claim 2 wherein said first and second channels have stepped profiles and provide means to engage two shingles in an overlapped configuration.

4. The roof vent claimed in claim 2 wherein said vent includes a wall which extends downward from said top surface, said wall having a second means to peripherally engage a shingle.

5. The roof vent claimed in claim 4 wherein said second means to peripherally engage a shingle comprise channel members extended from a top and bottom edges of said front wall.

6. The roof vent claimed in claim 3 further comprising a ridge along a rear edge of said top surface.

7. A passive roof vent comprising:

a base, a shaft extended from said base and a cap covering said shaft, said cap including a top surface parallel to said base;

said top surface having a plurality of side channels adapted to receive and retain at least one shingle to cover said top surface.

8. The roof vent claimed in claim 7 having first and second side channels and a bottom channel.

9. The roof vent claimed in claim 8 wherein said first and second side channels are stepped and adapted to retain two shingles in stepped overlapping relation.

10. The vent claimed in claim 7 wherein said cap further includes a downwardly extended front wall;

said front wall including channel sections adapted to receive and retain a shingle.

11. The vent claimed in claim 7 having two downwardly extending side walls, said side walls each having means to engage and retain shingles covering said side walls.

12. The vent claimed in claim 11 wherein said means to engage said shingles comprises upper and lower channels.

13. The vent claimed in claim 11 having a third wall extended down from said top surface, said third wall having means to engage and retain a shingle covering said third wall.

* * * * *